United States Patent [19]

DeFoe

[11] 4,235,219

[45] Nov. 25, 1980

[54] CONTROLLING THE DAMPING OF FLUES

[76] Inventor: Peter DeFoe, 1235 Meadows Sweet Rd., Golden, Colo. 80401

[21] Appl. No.: 26,045

[22] Filed: Apr. 2, 1979

[51] Int. Cl.[3] ..... F23L 3/00; G05D 23/02

[52] U.S. Cl. ..... 126/288; 236/93 R; 236/101 E; 98/85

[58] Field of Search ..... 98/85, 1; 126/288; 236/101 E, 49, 93 R

[56] References Cited

U.S. PATENT DOCUMENTS 2,042,688 6/1936 Tuck ..... 236/101 E 4,027,655 6/1977 Feldl ..... 126/288

*Primary Examiner*—William E. Wayner

*Attorney, Agent, or Firm*—George E. Kersey

[57] ABSTRACT

Control method and apparatus, particularly for the damping of flues. A control device employing a latch mechanism operated by a bimetallic strip is used, for example, to operate a damper through a linkage. After being engaged, the latch is set automatically when the level of heating rises above a first prescribed threshold. Thereafter, when the level of heating falls below a second prescribed threshold, the latch acts automatically, for example, through the linkage to close the damper.

10 Claims, 5 Drawing Figures

FIG. 3
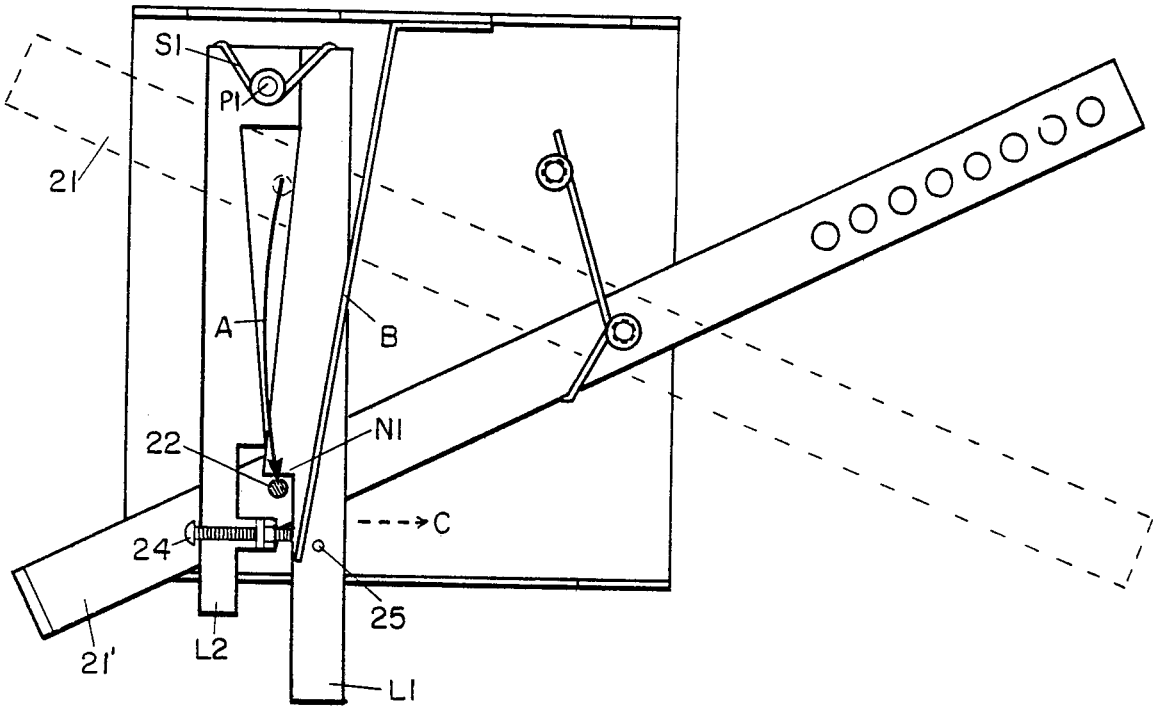
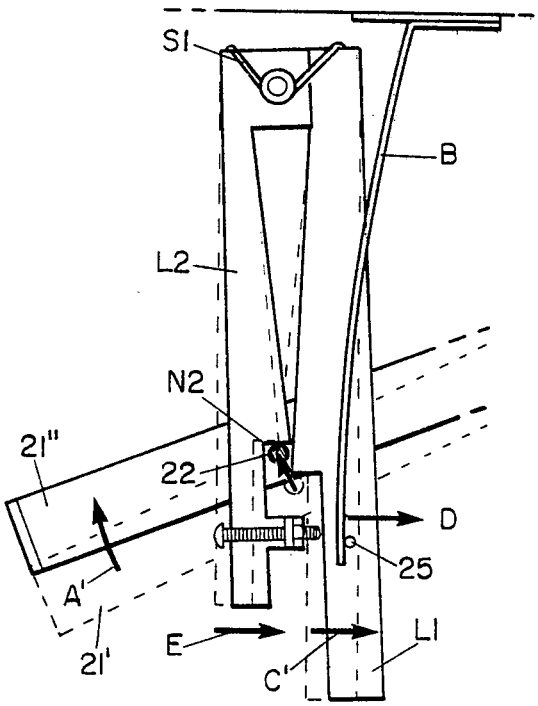
FIG. 4A
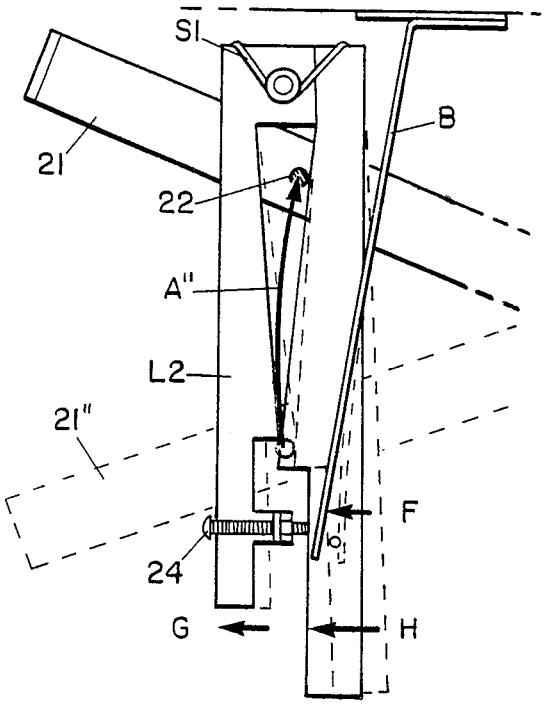
FIG. 4B

CONTROLLING THE DAMPING OF FLUES

BACKGROUND OF THE INVENTION

This invention relates to latch control, particularly over the damping of flues, and, more particularly, over the damping of fireplace flues.

It is common practice to employ a damper with a flue to control the loss of heat from within a structure. On a windy day, with the damper open, warm air tends to be drawn from the interior of the structure through the open flue by the syphoning action of the wind against the upper outlet of the flue. Conversely, on a cold still day, with the damper open, cold air tends to be drawn into the structure through the open flue. In either case, there is an objectionable loss of heat within the structure.

Accordingly, the conservation of heat within the structure requires careful attention to the damper. It should be closed whenever an open flue is not needed. Such is the case when there is no need to exhaust the byproducts of combustion or the fumes that are generated in certain production processes. Conversely, the damper must not be closed prematurely or the fumes that are to be exhausted will be diverted undersirably within the structure.

The typical damper is operated by the user, who waits for a suitable level of exhaust activity in the flue and then mechanically closes or opens the damper, according to the conditions then prevailing. This procedure has the objection that the user must be present at the time when the desired action is to be taken. Of course, even when the user is present, he may make an error in judgment and act upon the damper prematurely. This is particularly objectionable when the damper is closed too early. In addition the linkage used to operate the damper may be typically complex and relatively inaccessible.

Accordingly, it is an object of the invention to mechanize the control over the damping of flues. A related object is to mechanize the control over the damping of fireplace flues.

Another object of the invention is to guard against premature closure of the damper. A relative object is to prevent closure of a damper unless the heating effect associated with the damper control has fallen from a prescribed level.

In certain start-up situations the level of heating associated with a damper control may hover around a cut-off level. If the level of heating would then fall momentarily below the cut-off level, the damper could then be closed prematurely, and remain closed, even after the level of heating thereafter began to build to relatively high levels. Accordingly, another relative object of the invention is to effect automatic damper closure only after the level of heating associated with the control has clearly fallen below a safe level.

Various attempts have been made to provide for the automatic closure of flue dampers. One of these has been to use a paraffin cylinder which responds to heat by expanding and subsequent cooling by contracting. Not only is the use of such an element inconvenient, it is subject to malfunction either due to the loss of the paraffin or because of the inconsistent heating effects that can take place when paraffin is used. As a result the device is not failsafe. It can result in the closure of the damper while there is appreciable heating effect in the flue. In the case of a fireplace this can mean the introduction of unacceptable levels of smoke and soot into the interior of the building and in the case of a conventional energy system, premature closure of the damper can pose a safety hazard which can lead to overheating and premature combustion.

It is a further object of the invention to achieve automatic damper operation which is failsafe. A related object is to avoid the disadvantages of systems which employ chemical control elements such as paraffin.

Still another object of the invention is to provide an improved temperature control latch, particularly for dampers.

SUMMARY OF THE INVENTION

In accomplishing the foregoing and related objects, the invention provides for the automatic closure of a flue damper when the level of heating has reached a suitable level. In the case of a fireplace this is when the fire is out and the temperature has dropped to a level of between 80° and 90° F. This latter temperature is low enough that any coals remaining in the fireplace will not release noxious fumes and smoke.

In accordance with one aspect of the invention the automatic closure of the damper is accomplished by a control mechanism which is linked to the damper and becomes triggered for automatic operation when the level of heating reaches a prescribed level.

Thus in the case of a fireplace with the damper initially open, as the fire burns and the temperature in the flue builds, it reaches a level where heat acts upon an element that becomes triggered so that upon a subsequent reduction in the temperature of the flue there is a release of the trigger. This acts through the linkage and causes the damper to close. In the case of a fireplace, when the fire burns down and the temperature in the firebox drops to between 80° and 90° F., the damper becomes completely closed to prevent warm air from the interior of the building from escaping up the flue. Not only does the invention eliminate the escapage of warm interior air from the building, it keeps dirty ashes out of the building, saves energy and reduces heating bills.

In addition the damping system in accordance with the invention is failsafe. It cannot operate until the level of heating falls below the prescribed closure level.

In accordance with another aspect of the invention, the controller includes a pivoted first latch which engages a pivotal control lever when the latter has been pivoted to open a damper through an associated linkage. A bimetallic strip on the controller then acts on the first latch when a first threshold temperature is reached after a build-up from an ambient level.

In accordance with a further aspect of the invention, the controller includes a second latch which engages the control lever upon being released by the first latch. When the bimetallic strip cools to a second threshold temperature, it engages the second latch and releases the control lever, causing the damper to close through its associated linkage.

DESCRIPTION OF THE DRAWINGS

Other aspects of the invention will become apparent after considering several illustrative embodiments taken in conjunction with the drawings in which:

FIG. 3 is a plan view of the controller of FIG. 2 showing the control lever in the damper open position;

FIG. 4A is a partial view of FIG. 2 showing the triggering of the latches in the controller when heat in the flue has reached the first threshold level; and FIG. 4B is a further partial view of FIG. 2 showing the release of the control lever by the latches to bring about the closing of the damper after the heat in the flue has fallen below a second threshold level.

DETAILED DESCRIPTION

Figure 1:
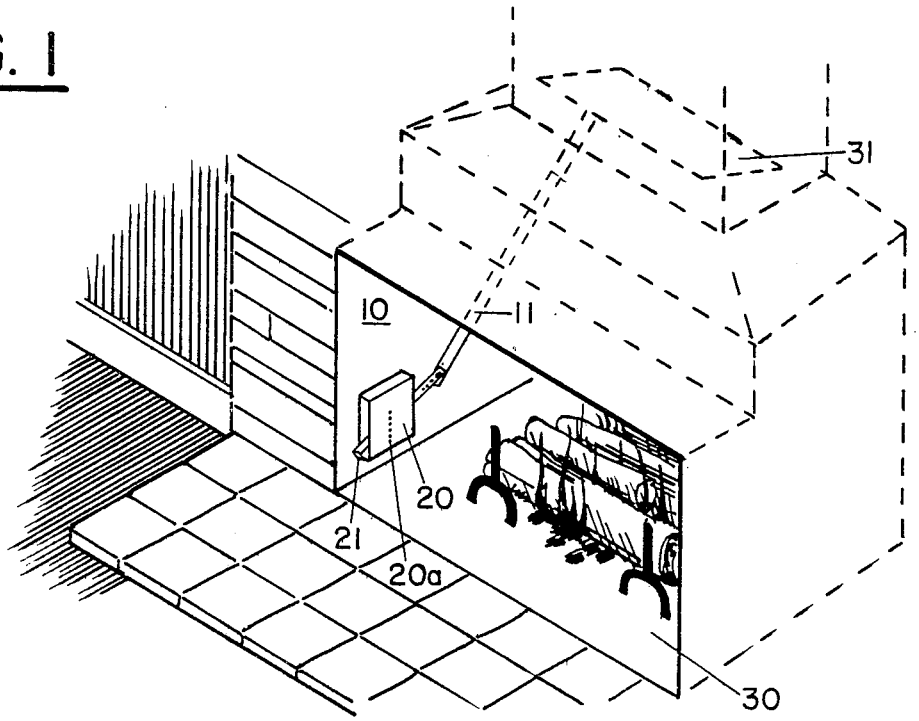
FIG. 1 is a prescriptive view of a damping system in accordance with the invention.

With reference to the drawings, a damping system 10 with a controller 20 for a fireplace 30 in accordance with the invention is shown in FIG. 1. The fireplace 30 is provided with a conventional damper 31 that is connected to the controller 20 by a suitable linkage 11. The damper 31 is shown partially open. It will be appreciated a wide variety of adjustments, settings and dispositions of the damper 31 are possible.

The controller 20 includes an operating lever 21 which is manually pushed downwardly to the position shown in FIG. 1 to open the damper 31 when a fire is to be started in the fireplace 30. The heating effect of the fire acts upon a temperature sensor element within the controller 20. When the temperature reaches a first threshold level, this triggers the controller mechanism 20 to prepare for closure of the damper 31 when the heat in the flue falls below a second threshold level. The heating effect on the sensor element within the controller 20 can be promoted by the inclusion of apertures 20*a* in the cover of the controller 20.

Figure 2:
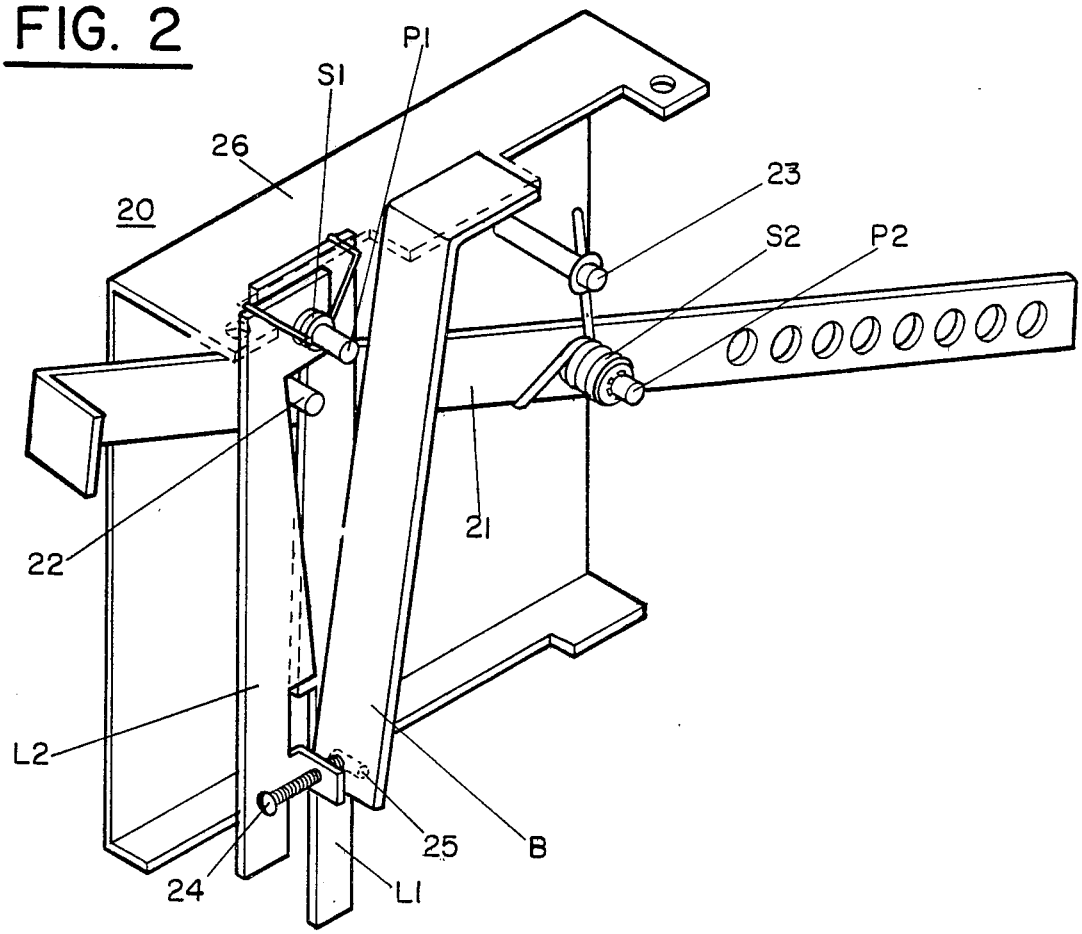
FIG. 2 is a prespective view with the cover removed of the controller for the damping system of FIG. 1.

The operation of the controller 20 is illustrated in conjunction with FIGS. 2, 3, 4A and 4B. Turning to FIG. 2, which is a perspective view of the controller 20 with its cover removed, it is seen that the controller includes a pair of latches L1 and L2 with a common pivot point P1. The latches L1 and L2 are biased towards one another by a spring S1 which is coiled at the pivot P1 and has opposite ends secured to the arms of the respective latches L1 and L2. The control lever 21, shown in its upper pivotal position in FIG. 2, includes a stud 22 which is initially positioned between the upper parts of the latches L1 and L2. The control lever 21 is pivoted at a position P2 and is biased by a spring S2 which has one end on the lever 21 and the other end on a projecting post 23.

The latches L1 and L2 have respective notches N1 (FIG. 3) and N2 (FIG. 4A). The notch N1 of the latch L1 is lower in position with respect to the Pivot P1 than is the notch N2 of the latch L2 for reasons which will appear shortly. In addition the latch L2 includes an adjustable set-screw 24, while the latch L1 includes a post 25.

As indicated in FIG. 2, initially the end of the set-screw 24 rests on the tongue of a cantilevered, bimetallic strip B which is secured to the upper flange 26 of the controller 20, with tongue slightly displaced from the post 25.

When the control lever 21 is pushed downwardly as shown in FIG. 3, from the intitial phantom position 21 to the set position 21', the stud 22 travels as indicated by the arrow A. When the stud 22 comes into contact with the latch L1 near the notch N1, the latch L1 is pivoted counterclockwise in the direction indicated by the phantom arrow C. When the post 22 reaches the inside shoulder of the notch N1, the latch L1 then returns to its initial position to seat and hold the post 22 in the notch N1. The control lever 21 is now set so that the damper 31 operated through the linkage 11 of FIG. 1 is open. It will be understood that the notch N1 is configured to capture and hold the stud 22, The notch N1 in FIG. 3 has a right-angled shoulder. This angle may be made greater than, or less than 90°, depending upon the coefficient of friction of the materials and the kind of lubricant employed with the stud 22. In general any stable lubricant which can withstand the temperature conditions encountered in the vicinity of the controller 20 can be used.

The automatic operation of the controller 20 is illustrated in FIGS. 4A and 4B. When the fire in the fireplace 30 builds up, the heating effect causes the bimetallic strip B to flex in the direction D shown in FIG. 4A. This brings the strip B into contact with the post 25 of the latch L1, causing the latch to also pivot counterclockwise from its phantom position, as indicated by the arrow C' of FIG. 4A. When the latch L1 has pivoted sufficiently the post 22 of the control lever 21 is released from the notch N1. Because of the effect of the spring S1 on the second latch L2, it pivots in a counterclockwise direction indicated by the arrow E, capturing the post 22 in the notch N2, as indicated in FIG. 4A. The control lever 21 corresponding moves from its phantom position 21' to its capture position 21''. The controller 20 has now been set.

Any further heating effect will simply cause the bimetallic strip B to move further in the counterclockwise direction indicated by the arrow D, with no effect on the control lever 21''. However, when the heating effect is reduced, the bimetallic strip B begins to reverse direction as indicated by the arrow F in FIG. 4B. The latch L1 correspondingly moves in the direction H because of the spring S1. When the heating effect is reduced to a level where the tongue of the strip B is in contact with the set-screw 24, any further cooling will cause the latch L2 to pivot in a clockwise direction indicated by the arrow G in FIG. 4B, thus releasing the post 22 and allowing the control lever 21 to return to the damper closed position indicated in FIGS. 1 and 2.

It will be appreciated that the bimetallic strip B may be a laminate of two dissimilar metals which exhibit the usual differential contraction when exposed to heating, oriented so that an increase in heating will cause a pivoted deflection in the direction indicated by the arrow D in FIG. 4A.

A suitable bimetallic strip B is provided by a bonded laminate of low expansion Invar (36 percent nickle and balance iron) and a high expansion alloy of 22 percent nickel, 3 percent chrominium and balance iron; ASTM grade No. TM-1 and B106 flexivity of $146\times10^{-7}$. Such a liminate is available from the Hood Metal Company of Hamburg, Pennsylvania as No. 36-22 and said to be equivalent to product B1 available from the Texas Instrument Co. of Attleboro, Mass.

While various aspects of the invention have been set forth by the drawings and specification, it is to be understood that the foregoing detailed description is for illustration only and that various changes in parts, as well as the substitution of equivalent constituents for those shown and described may be made without departing from the spirit and scope of the invention as set forth in the appended claims.

What is claimed is:

1. A controller comprising a first latch member;

a pivoted control lever engagable by said first latch member; a bimetallic strip acting upon said first latch member to release said control lever when a first threshold temperature is reached a second latch member which engages said control lever when reached by said first latch member; said first latch member and said latch member having a common pivot.

2. A controller as defined in claim 1 wherein the engagable means of said second latch member is adjustable.

3. A controller as defined in claim 1 wherein said bimetallic strip is cantilever mounted.

4. A controller as defined in claim 1 wherein said first latch member and said second latch member are spring loaded by the same spring at said common pivot.

5. A controller comprising a first latch member;

a pivoted control lever engagable by said first latch member;

a bimetallic strip acting upon said first latch member to release said control lever when a first threshold temperature is reached;

and a second latch member which engages said control lever when released by said first latch member; said second latch member including means engagable by said bimetallic strip to release said control lever when a second threshold temperature is reached.

6. A controller as defined in claim 5 wherein said control lever is connected to a linkage.

7. A controller as defined in claim 6 wherein said linkage is connected to a damper.

8. A controller as defined in claim 7 wherein said linkage is connected to a fireplace damper and said control lever is released from said first latch member to said second latch member when said first threshold temperature is reached, as is thereafter released from said second latch member when said second threshold temperature is reached.

9. A controller as defined in claim 5 wherein the engagable means of said second latch member is adjustable.

10. A controller as defined in claim 5 wherein said bimetallic strip is cantilever mounted.

* * * * *